US006162525A

United States Patent [19]

Amy

[11] Patent Number: 6,162,525

[45] Date of Patent: Dec. 19, 2000

[54] DRYWALL PATCH

[76] Inventor: Ira Amy, P.O. Box 147, Hay Lakes, Alberta, Canada, T0B 1W0

[21] Appl. No.: 09/140,147

[22] Filed: Aug. 26, 1998

[51] Int. Cl.[7] ..... B32B 35/00; B32B 3/02

[52] U.S. Cl. ..... 428/119; 428/131; 428/63; 428/192; 156/98; 156/94; 156/71; 52/514; 29/402.09; 29/402.11

[58] Field of Search ..... 428/131, 63, 119, 428/192; 156/98, 94, 71; 52/514; 29/402.09, 402.11

[56] References Cited

U.S. PATENT DOCUMENTS

| | | | |
|---|---|---|---|
| 3,999,347 | 12/1976 | Devlin | 52/514 |
| 4,135,017 | 1/1979 | Hoffmann, Sr. | 428/78 |
| 4,358,495 | 11/1982 | Parker | 428/66 |
| 4,460,420 | 7/1984 | Estrada | 156/64 |
| 4,620,407 | 11/1986 | Scmid | 52/741 |
| 4,761,319 | 8/1988 | Kraus et al. | 428/99 |
| 5,200,244 | 4/1993 | Keller | 428/81 |
| 5,269,861 | 12/1993 | Gilbreath | 156/98 |
| 5,620,768 | 4/1997 | Hoffmann, Sr. | 428/77 |

OTHER PUBLICATIONS

Canadian Gypsum Company product brochure, entitled "Drywall Repair Clips", 2 pages, 1995.

*Primary Examiner*—William P. Watkins, III
*Attorney, Agent, or Firm*—Davis and Bujold

[57] ABSTRACT

A drywall patch includes a substantially planar body having a peripheral edge. A depending skirt is spaced from the peripheral edge of the body. The depending skirt is extended into an opening in drywall to prevent lateral movement of the drywall patch during application.

9 Claims, 4 Drawing Sheets

DRYWALL PATCH

FIELD OF THE INVENTION

The present invention relates to a drywall patch for patching holes made in drywall.

BACKGROUND OF THE INVENTION

During the course of constructing a building out of drywall, openings through the drywall intended to accommodate electrical receptacles and the like are sometimes incorrectly positioned. When this occurs the unwanted opening through the drywall must be patched. There are, of course, an infinite variety ways that a person can find himself or herself with an unwanted hole or opening through the drywall that must be patched.

Although a number of patents disclose methods or apparatus for patching drywall, none of the solutions disclosed has achieved commercial acceptance. U.S. Pat. No. 3,999,347 which issued to Devlin in 1976 entitled "Handy Helper", discloses a clamp like tool. This tool has a bow member and a centrally positioned adjustable stem member. The stem member is attached to a piece of scrap board. The scrap board is inserted through an opening in the drywall that is to be patched. The scrap board is held up against the inside of the drywall by tightening the stem of the tool. A patching compound is then applied to the opening, using the scrap board for rear support. When the patching is completed, the stem is withdrawn and the scrap board is left in the wall. The scrap board serves as temporary backing while during the patching process. U.S. Pat. No. 4,358,495 which issued to Parker in 1982 is entitled "Drywall Patch Kit". The kit includes sandpaper, a putty knife, a tube of joint filler compound, and a plurality of patches of varying sizes. Each patch consists of two circular-shaped layers of drywall paper cemented together. The patch is made pliable by dipping in water prior to application. The patch is slightly larger than the opening being patched. This provides a single thickness of material around the outer edge of the opening for blending in with the wall and a double thickness over the opening for enhanced reinforcement. U.S. Pat. No. 4,620,407 which issued to Schmid in 1986 is entitled "Method for Drywall Patching". The method disclosed involves the use of a rectangular shaped repair plug having a front wall, a rear wall and edges which slope inwardly from the front wall to the rear wall. A rectangular shaped opening is made through the drywall with corresponding sloped walls. The mating of the sloped walls of the repair plug and sloped walls of the opening serve as backing for the repair plug.

Each of the patents described above provides certain advantages and has certain inherent disadvantages. With the drywall patch disclosed by Parker, care must be taken to ensure that the patch does not slide laterally out of position during application. Once the patch has dried and set into position, problems can be experienced due to the fact the patch has no permanent backing. An object striking the patched area would likely punch a hole through the two thin ply patch material. The teaching of Devlin requires the use of a joint filler compound without backing. As with the Parker patch, the Devlin patch would be susceptible to damage is accidentally struck. A further problem may be experienced even in the absence of striking if the joint filler compound experiences shrinkage. The most practical of the teachings is that of Schmid. The patch taught by Schmid is installed in such a manner that it has solid backing. It takes preparation in order to ensure that both the opening and the patch have sloped edges. It is difficult, if not impossible, to get the sloped edges exactly perfect, so that the distance that the patch extends into the opening will vary. When the patch extends into the opening deeper than is desirable, filling will be required. The patch should be durable enough to withstand blows experienced through normal use.

SUMMARY OF THE INVENTION

What is required is an improved form of drywall patch.

According to the present invention there is provided a drywall patch which includes a substantially planar body having a peripheral edge. A depending skirt is spaced from the peripheral edge of the body.

The drywall patch, as described above, is simple to work with and is prevented from moving laterally by the depending skirt.

Although beneficial results may be obtained through the use of the drywall patch, as described above, some simple measures can be made to strengthen the drywall patch thereby improving its performance. The strength of the drywall patch is increased substantially when the planar body is constructed of a mesh material, preferably fibreglass. The strength of the drywall patch can be even further increased when the depending skirt defines a rectangular cavity in which is positioned a drywall plug which provides backing and reinforcement for the fibreglass mesh body.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
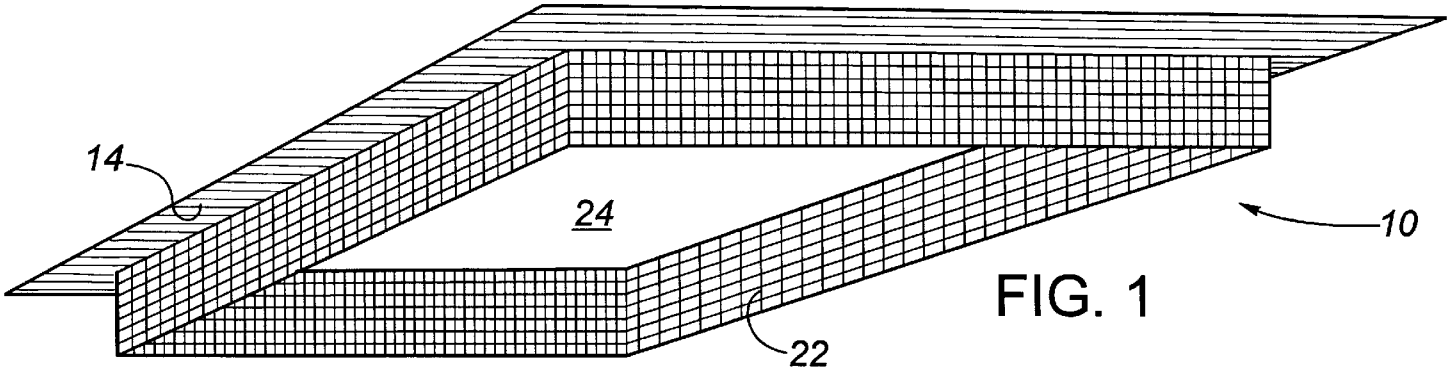
FIG. 1 is a bottom perspective view of a first embodiment of a drywall patch constructed in accordance with the teachings of the present invention.

The preferred embodiment, a drywall patch generally identified by reference numeral 10, will now be described with reference to FIGS. 1 through 6.

Figure 3:
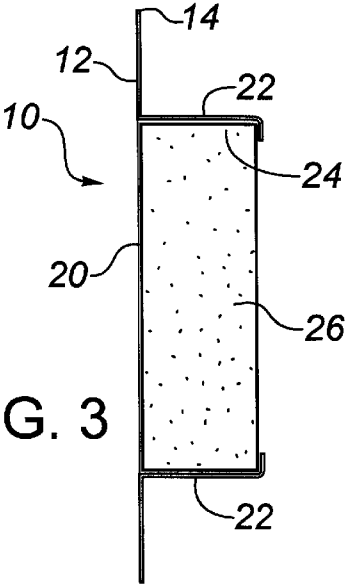
FIG. 3 is a side elevation view, in section, of a second embodiment of drywall patch constructed in accordance with the teachings of the present invention.
Figure 2:
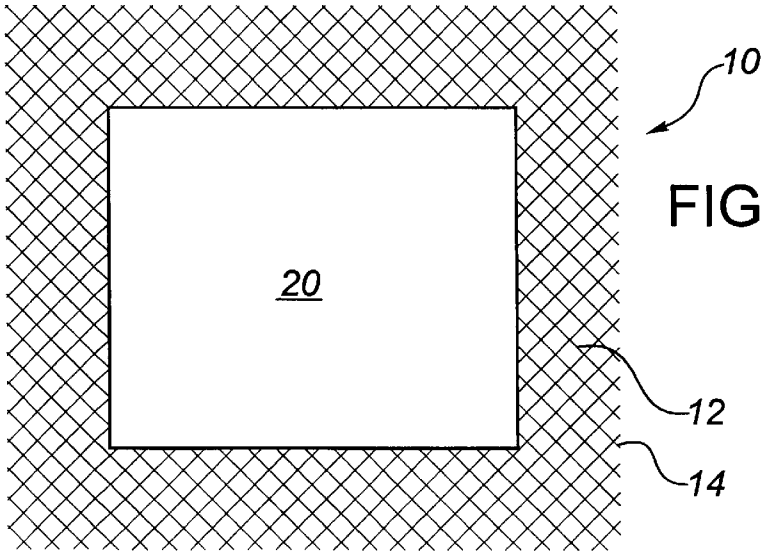
FIG. 2 is a top plan view of the drywall patch illustrated in FIG. 1.
Figure 6:
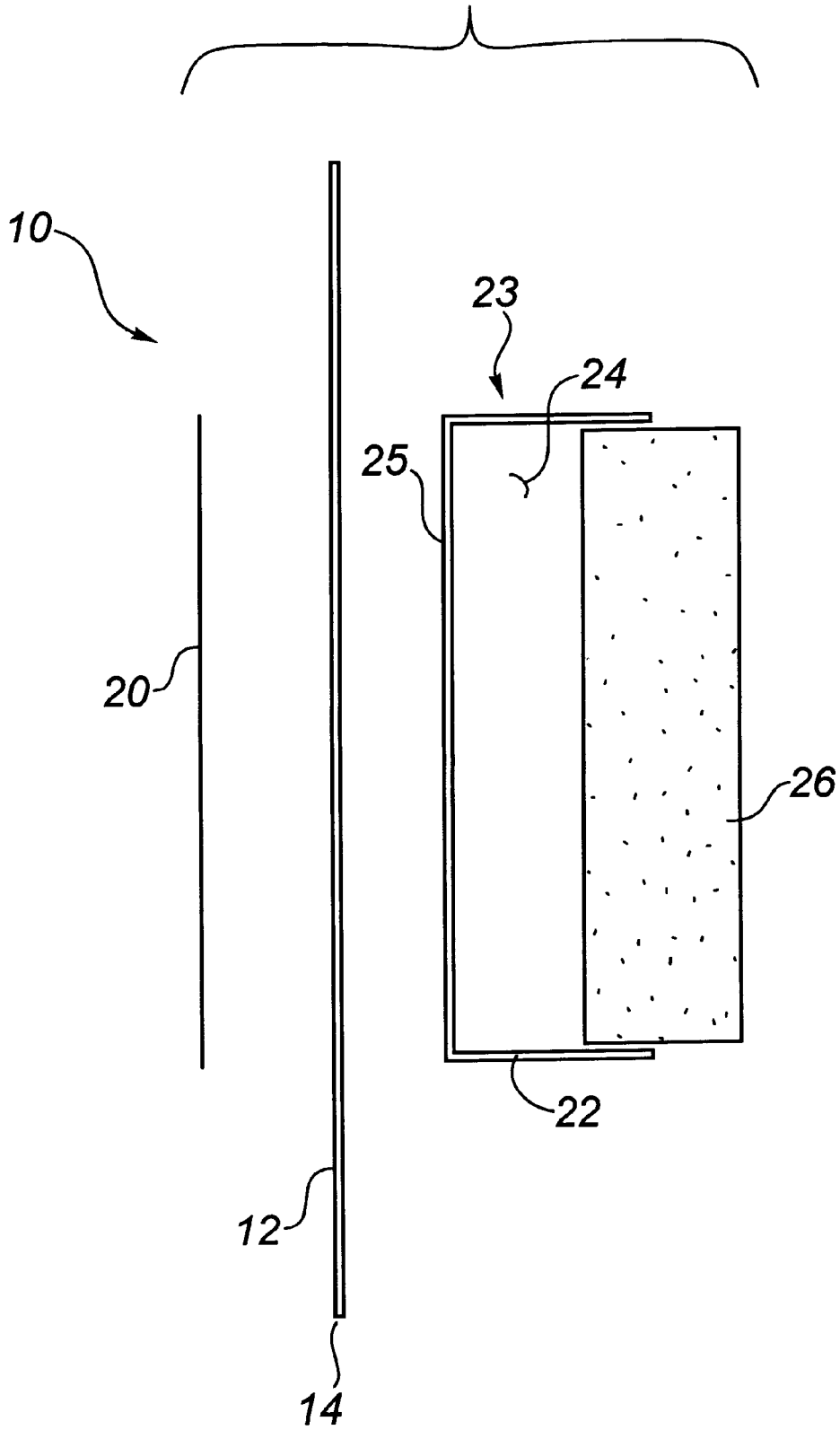
FIG. 6 is an exploded side elevation view, in section, of the drywall patch illustrated in FIG. 3.

Referring to FIG. 2, drywall patch 10 includes a rectangular, preferably square, planar body 12 having a peripheral edge 14. Planar body 12 is constructed out of a fibreglass mesh material across which extends a layer of drywall paper 20. Referring to FIG. 1, a rectangular depending skirt 22 is spaced from peripheral edge 14 of fibreglass mesh body 12. Depending skirt 22 defines a rectangular cavity 24. Referring to FIGS. 3 and 6, there is illustrated a best mode of drywall patch 10. For ease of assembly, depending skirt 22 is integrally formed at part of a shallow pan or basket 23. Pan or basket 23 can be made of moulded polymer plastic or wire. The advantage this construction provides is that planar fibreglass mesh body 12 can be secured by adhesive to a bottom surface 25 of pan or basket 23. In applications where strength is of importance, a drywall plug 26 is fixed within rectangular cavity 24 to provide additional reinforcement, beyond that provided by pan or basket 23.

Figure 4:
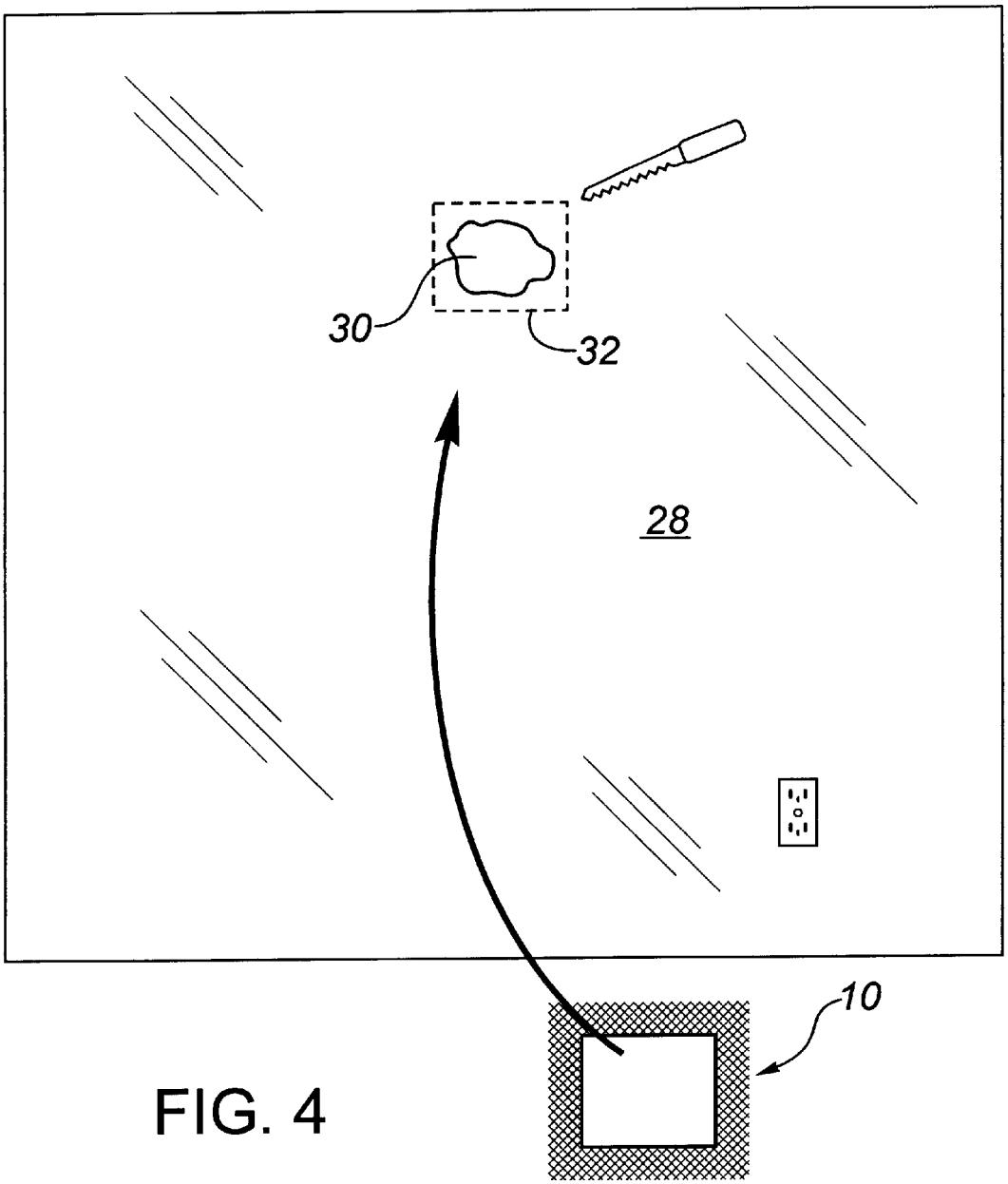
FIG. 4 is front elevation view of a wall having an opening requiring a drywall patch.
Figure 5:
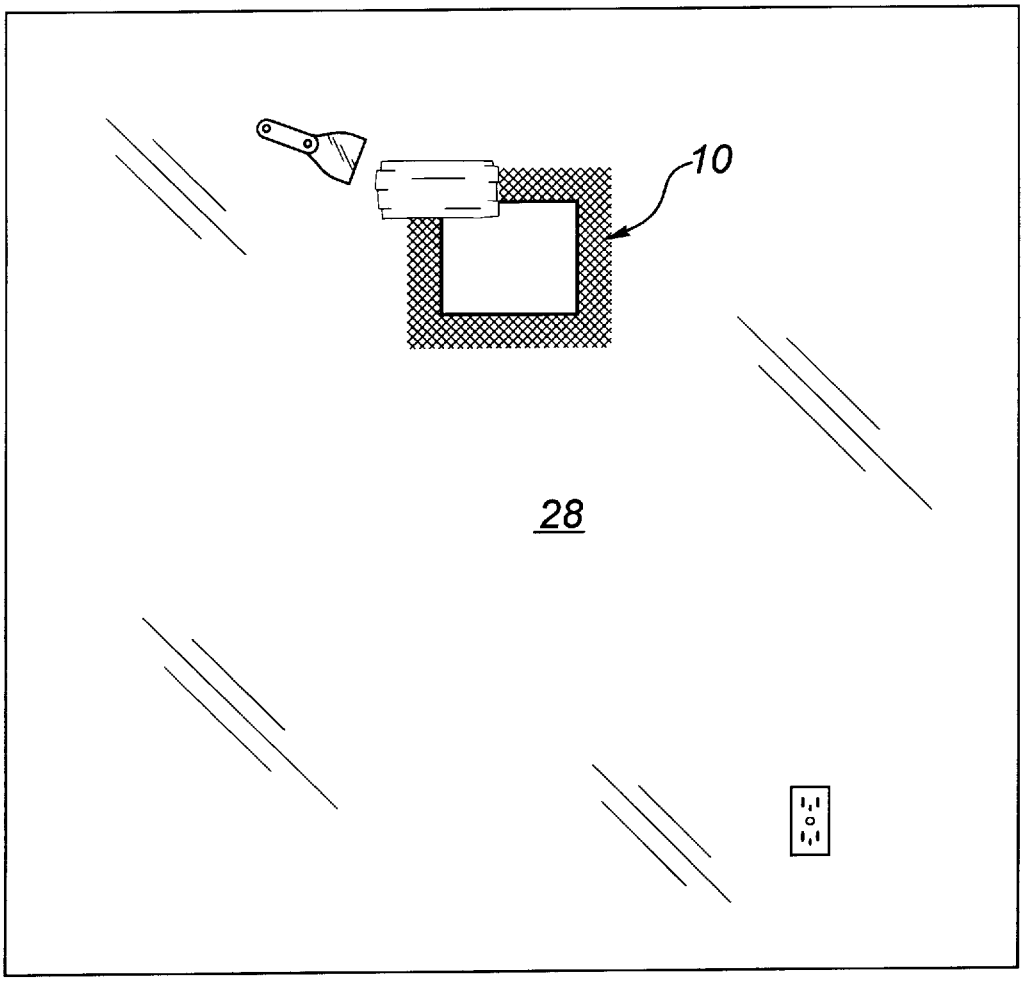
FIG. 5 is front elevation view of the wall illustrated in FIG. 4 with the drywall patch illustrated in FIG. 3 inserted into the opening.

The operation of use of drywall patch 10 will now be described with reference to FIGS. 1 through 6. Referring to FIG. 4, there is illustrated a wall 28 constructed of drywall and having an hole 30 requiring patching. A rectangular opening 32 is cut in wall 28 of a size corresponding to the dimensions of rectangular skirt 22 of drywall patch 10. Rectangular opening 32 encompasses within it hole 30. Referring to FIG. 3, rectangular skirt 22 of drywall patch 10 is then inserted into opening 32 with fibreglass mesh body 12 overlying wall 28. Referring to FIG. 5, joint filler is then placed over fibreglass mesh body 12 to cement drywall patch 10 in position. Referring to FIG. 3, once the patch job is completed, drywall patch 10 cannot be pushed through opening 32 due to the adherence of fibreglass mesh body 12 to wall 28. Drywall patch 10 does not readily puncture due to the strength provided my the fibreglass mesh out of which body 12 is constructed, the further reinforcement provided by bottom surface 25 of pan or basket 23 and still further reinforcement provided, when required, by the positioning of drywall plug 26 within rectangular cavity 24. Drywall patch 10 will not move laterally because of depending skirt 22 and, where applicable, drywall plug 26.

It will be apparent to one skilled in the art the relative ease with which drywall patch 10 may be installed. It will also be apparent to one skilled in the art the relative strength that drywall patch 10 provides. It will finally be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A drywall patch, comprising:

a substantially planar body having a peripheral edge; and a depending skirt spaced from the peripheral edge of the body, the depending skirt being integrally formed as an uninterrupted peripheral sidewall of one of a molded polymer plastic pan and a wire mesh basket, and a bottom of the one of a molded polymer plastic pan and a wire mesh basket being secured to the body by adhesive.

2. The drywall patch as defined in claim 1, wherein the planar body is rectangular.

3. The drywall patch as defined in claim 1, wherein the depending skirt defines a rectangular cavity.

4. The drywall patch as defined in claim 1, wherein the planar body is constructed of a fibreglass mesh material.

5. The drywall patch as defined in claim 4, wherein the planar body is covered by at least one layer of drywall paper.

6. A drywall patch, comprising:

a rectangular planar fibreglass mesh body having a peripheral edge;

at least one layer of drywall paper covering the mesh body; and a depending skirt spaced from the peripheral edge of the body, the depending skirt being integrally formed as an uninterrupted peripheral sidewall of a wire mesh basket, a bottom of the wire mesh basket secured by adhesive to the body, thereby maintaining the depending skirt in position.

7. The drywall patch as defined in claim 6, wherein the depending skirt defines a rectangular cavity and a drywall plug is positioned in the rectangular cavity.

8. A drywall patch, comprising:

a rectangular planar fibreglass mesh body having a peripheral edge;

at least one layer of drywall paper partially covering the mesh body; and a depending skirt spaced from the peripheral edge of the body, the depending skirt being integrally formed as an uninterrupted peripheral sidewall of a polymer plastic pan, a bottom of the polymer plastic pan being secured by adhesive to the body.

9. The drywall patch as defined in claim 8, wherein the depending skirt defines a rectangular cavity and a drywall plug is fixedly positioned in the rectangular cavity.

* * * * *